US006606948B1

(12) United States Patent
Austin et al.

(10) Patent No.: US 6,606,948 B1
(45) Date of Patent: Aug. 19, 2003

(54) METHOD FOR CONTROLLING A CHILL ROLL SYSTEM

(75) Inventors: Stephen Arthur Austin, Strafford, NH (US); David Robert Dawley, Rochester, NH (US); Neil Doherty, Durham, NH (US); Kent Dirksen Kasper, Portsmouth, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/094,787

(22) Filed: Mar. 11, 2002

(51) Int. Cl.[7] ..... B41F 23/04; B41F 5/04

(52) U.S. Cl. ..... 101/487; 101/216; 101/483; 101/219

(58) Field of Search ..... 101/488, 487, 101/483, 457, 216, 152, 153, 219, 424.1; 118/60

(56) References Cited

U.S. PATENT DOCUMENTS

| | | | | | |
|---|---|---|---|---|---|
| 4,920,881 | A | * | 5/1990 | Tafel | 101/488 |
| 5,275,103 | A | | 1/1994 | Hahne | 101/488 |
| 5,346,385 | A | * | 9/1994 | McAleavey | 118/101 |
| 5,465,661 | A | | 11/1995 | White | 101/219 |
| 5,475,986 | A | * | 12/1995 | Bahel | 62/160 |
| 5,571,564 | A | | 11/1996 | Helms et al. | 427/288 |
| 5,676,754 | A | * | 10/1997 | Helms et al. | 101/487 |
| 5,918,541 | A | | 7/1999 | Ahnen | 101/219 |
| 6,202,556 | B1 | | 3/2001 | Lagger | 101/216 |
| 6,220,161 | B1 | * | 4/2001 | De Vroome | 101/424.1 |
| 6,532,792 | B2 | * | 3/2003 | Lloyd et al. | 73/232 |

FOREIGN PATENT DOCUMENTS

| | | |
|---|---|---|
| DE | 8805176.5 | 7/1988 |
| DE | 19710124 | 9/1998 |

* cited by examiner

*Primary Examiner*—Eugene H. Eickholt
(74) *Attorney, Agent, or Firm*—Davidson, Davidson & Kappel, LLC

(57) ABSTRACT

A method for controlling a chill roll system in a web printing press includes calculating, based on a web inlet temperature of a web entering a first chill roll of the chill roll system, a dew point temperature of an ink solvent vapor of ink printed on the web is calculated. The inlet coolant temperature of coolant entering the first chill roll is set to temperature value near the calculated dew point temperature. Using a heat transfer model, the flow rate of the coolant through the first chill roll needed to maintain a temperature rise of the coolant through the first chill roll below a predetermined value is determined. The method prevents post-chill marking by sufficiently cooling the web, and sets chill roll temperature profiles to avoid solvent condensation on chill roll surfaces and thereby avoid condensate marking.

20 Claims, 2 Drawing Sheets

METHOD FOR CONTROLLING A CHILL ROLL SYSTEM

BACKGROUND

The present invention relates generally to chill rolls for web offset printing presses, and in particular to a method for controlling a chill roll system using a heat transfer model and press speed to determine the proper coolant temperature and coolant flow rate for a chill roll.

In web offset printing presses, ink is applied to an elongated web of paper or other material as the web is moved lengthwise through the printing press. The freshly printed web is moved through a drier, which elevates the temperature of the web. The web is then moved through a chill roll assembly in order to cool the heated web and to set the ink. A chill roll assembly typically includes a succession of rolls which are cooled by water or other coolant flowing through the interior of the rolls.

To avoid print defects, it is important to properly control both the temperature of the web exiting the chill roll assembly and the temperatures of the chill rolls. If the web exit temperature is not sufficiently low, for example less than 90° F., then post-chill marking may occur. On the other hand, cooling the web beyond a desired exit temperature may be an unnecessary waste of energy. Avoiding chill condensate on chill roll surfaces is also important. If a roll is too cool, ink solvent will condense on the roll surface. If a roll is too hot, the web is not cooled sufficiently and an excessive number of rolls is required to cool the web to the desired exit temperature.

Various methods and devices have been used in an attempt to properly control web and/or chill roll temperatures. U.S. Pat. No. 6,202,556 describes using a mixing valve to maintain a desired cooling water temperature. U.S. Pat. No. 5,571,564 describes using a cooled nip roll in contact with a chill roll to improve cooling efficiency and avoid condensate streaking. U.S. Pat. No. 5,275,103 describes using an electrically charged plate electrode for reducing the air gap between the web and the chill roll surface so as to improve cooling efficiency and reduce ink solvent vapors between the web and the chill roll. U.S. Pat. No. 5,465,661 describes adjusting the flow rate of a coolant pump to maintain press temperatures. U.S. Pat. No. 5,918,541 describes warming the coolant upon a web stop to avoid the formation condensation from the air.

DE 197 10 124 A1 describes a chill roll system having separate coolant circuits, whose temperature and flow rate can be independently controlled. DE 88 05 176 describes a chill roll system in which two chill rolls are connected in series with each other and in parallel with two other chill rolls. It is known to use the measured temperature of the coolant to control the chill roll system, as in the HWS HCR-9 chill roll system of Heidelberg Web Systems. Moreover, using Baldwin chill roll wipers to remove condensate from the chill surface is known.

The prior systems and methods tend to be iterative, reacting to temperature changes. These prior systems and methods cannot predict thermal loading at speed changes to determine the required coolant temperatures and flow rates.

SUMMARY OF THE INVENTION

The present invention provides a method for controlling a chill roll system in a web printing press. The method includes calculating, based on a web inlet temperature of a web entering a first chill roll of the chill roll system, a dew point temperature of an ink solvent vapor of ink printed on the web is calculated. The inlet coolant temperature of coolant entering the first chill roll is set to temperature value near the calculated dew point temperature. Using a heat transfer model, the flow rate of the coolant through the first chill roll needed to maintain a temperature rise of the coolant through the first chill roll below a predetermined value is determined.

The heat transfer model may be a theoretical and/or an empirical model. The heat transfer model may be adaptive to process measurements.

The first temperature value may be equal to an offset below the calculated dew point temperature.

The method according to the present invention may further include performing the calculating, setting and determining steps for at least a second chill roll of the chill roll system.

Moreover, the method may include calculating a web exit temperature of the web exiting the first chill roll. When the calculated web exit temperature is close to a desired web exit temperature, the method may include setting respective inlet coolant temperatures of coolant entering chill rolls downstream of the first chill roll to a second temperature value based on the desired web exit temperature and setting respective flow rates of coolant through the downstream chill rolls to a minimal flow rate so as to maintain the web at the desired web exit temperature through the downstream chill rolls. The second temperature value may be equal to an offset below the desired web exit temperature.

Setting the inlet coolant temperature of coolant entering the first chill roll may be performed using at least one of a coolant heat exchanger and a coolant mixing valve of the chill roll system.

A computer processing device may be used to calculate the dew point temperature for vapor of the ink solvent and/or to determine the coolant flow rate of the coolant through the first chill roll needed to maintain the temperature rise of the coolant through the first chill roll below the predetermined value.

The method according to the present invention may further include adjusting at least one of the coolant flow rate and the inlet coolant temperature based on a measured web exit temperature of the web exiting the first chill roll. Moreover, the method may include adjusting at least one of a second coolant flow rate and a second inlet coolant temperature of a second chill roll upstream of the first chill roll based on a measured web exit temperature of the web exiting the first chill roll. Still moreover, the method may include adjusting at least one of the coolant flow rate and the inlet coolant temperature based on a measured outlet coolant temperature of coolant exiting the first chill roll.

The method according to the present invention may further include manually adjusting at least one of the coolant flow rate and the inlet coolant temperature based on at least one of a measured temperature of a surface of the first chill roll, a measured temperature rise of the coolant through the first chill roll, and a measured web exit temperature of the web exiting the first chill roll.

The present invention also provides a web printing press having a chill roll control apparatus for a chill roll of a web printing press. The chill roll control apparatus includes a temperature sensor for detecting a web inlet temperature of a web entering the chill roll; and a computer processing device for calculating, based on the web inlet temperature, a dew point temperature for vapor of an ink solvent of ink printed on the web; and determining, using a heat transfer model, a coolant flow rate of a coolant through the chill roll needed to maintain a temperature rise of the coolant through the chill roll below a predetermined value. A controllable heat removal system is also provided for setting an inlet coolant temperature of the coolant entering the chill roll to a first temperature value based on the calculated dew point temperature.

The method and apparatus according to the present invention prevent post-chill marking by sufficiently cooling the web, and sets chill roll temperature profiles to avoid solvent condensation on chill roll surfaces and thereby avoid condensate marking.

DESCRIPTION OF THE DRAWINGS

The present invention is elaborated upon below based on exemplary embodiments with reference to the accompanying drawings.

DETAILED DESCRIPTION

Figure 1:
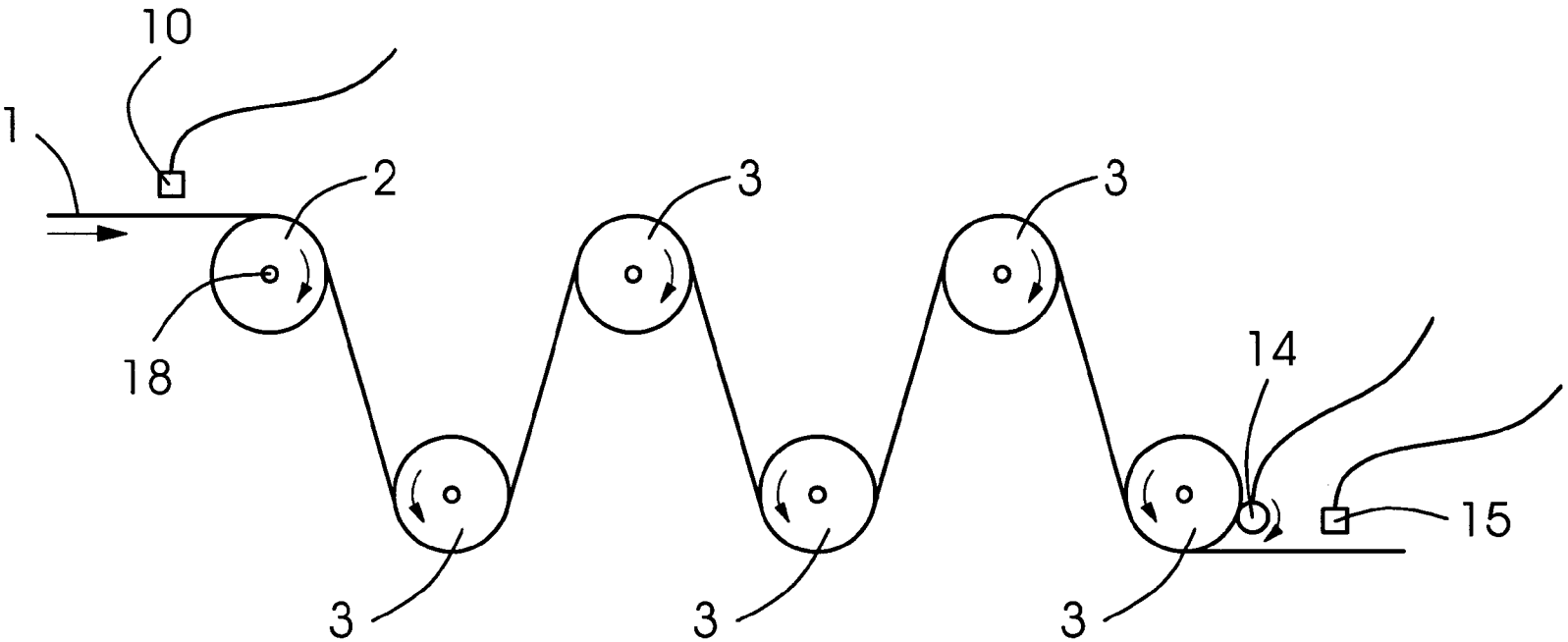
FIG. 1 shows a side schematic view of chill roll system having a chill roll control apparatus according to an embodiment of the present invention.
Figure 2:
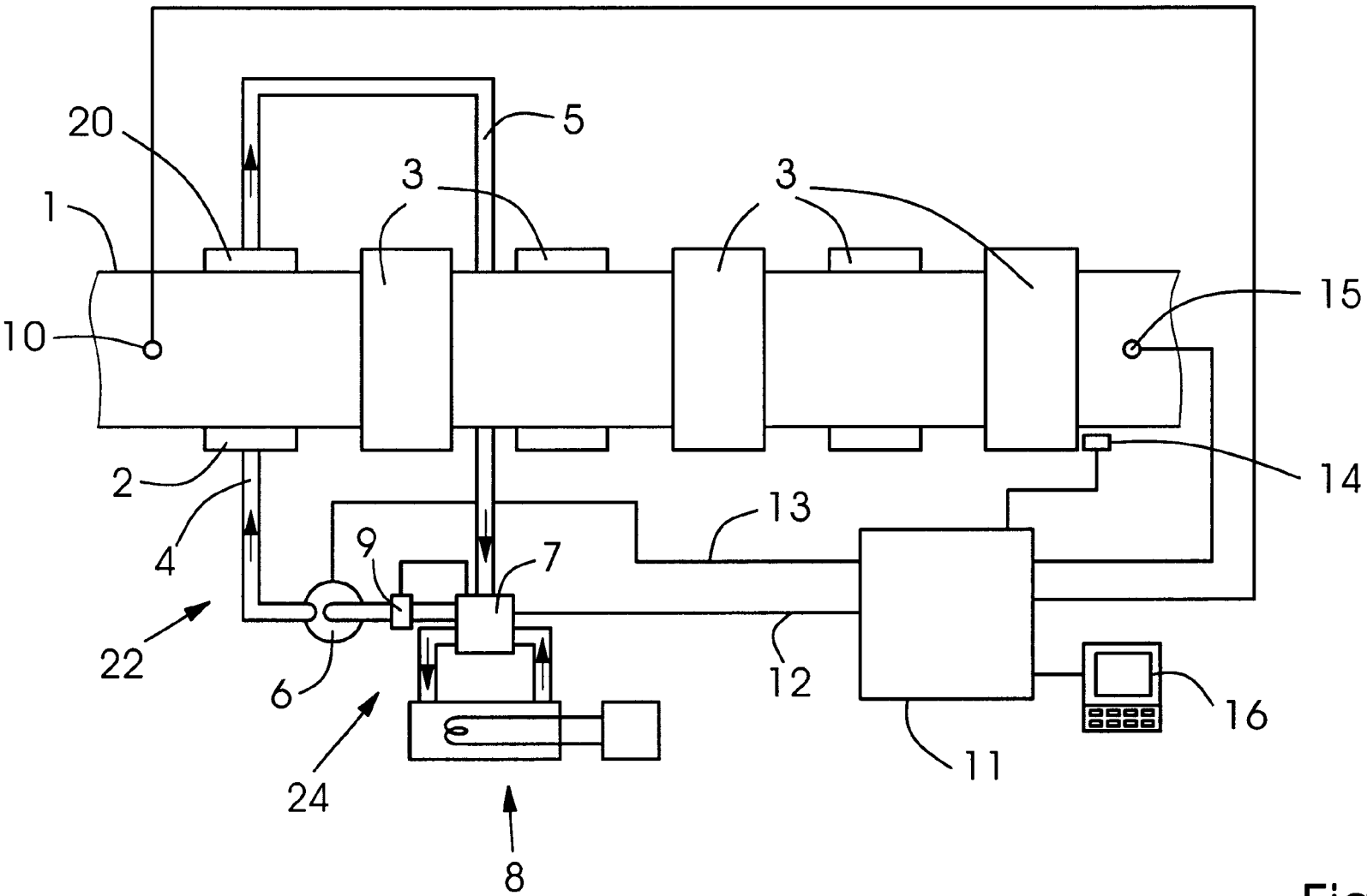
FIG. 2 shows a top schematic view of the chill roll system shown in FIG. 1.

Referring to FIGS. 1 and 2, a chill roll system includes first chill roll 2 and downstream chill rolls 3. Chill rolls 2, 3 have a generally cylindrical shape and each rotate about a respective axis 18. Web 1, warmed by an upstream dryer (not shown), contacts chill rolls 2, 3 as it follows a path through the chill rolls as shown. Heat is removed from web 1 by coolant 4, 5 flowing through chill rolls 2, 3. Coolant flow rate through chill rolls 2, 3 is regulated by variable speed motor driven pump 6. The temperature of inlet coolant 4 is regulated by mixing valve 7, which mixes return, or exit, coolant 5 with coolant cooled by heat exchanger 8. Mixing valve 7 is regulated using temperature sensor 9 disposed in the coolant flow path to pump 6.

Chill rolls 2, 3 may be any suitable type of chill roll capable of having coolant through the chill roll and remove heat therefrom. U.S. Pat. No. 3,676,910, for example, describes the construction of a typical chill roll. Any number of chill rolls, from one upward, may be used, depending on system requirements.

Coolant 4, 5 may be water or any suitable fluid for removing heat from chill rolls 2, 3. Pump 6 may be a rotary pump or any suitable fluid moving device. Mixing valve 7 may be any suitable valve device for diverting coolant from coolant recirculation path 22 into heat exchanger 8 and from heat exchanger 8 into from coolant recirculation path 22.

For simplicity, only one coolant recirculation path 22, for chill roll 2, and one coolant control system 24, including temperature sensor 9 and mixing valve 7, for example, is depicted in FIG. 2. Each chill roll 3 has a coolant recirculation path, which may be part of, or independent of, coolant recirculation path 22. Coolant may, for example, flow through chill rolls 2, 3 in series or in a parallel configuration. Similarly, coolant circulation through each chill roll 3 may be controlled by coolant control system 24, or each chill roll 3 may have its own associated coolant control system. Various configurations with varying numbers of pumps, temperature sensors, heat exchangers and mixing valves, are possible as would be understood by those of skill in the art, and are intended to be within the scope of the present invention. For simplicity of discussion, it is assumed below that inlet coolant 4 is independently temperature and flow rate controllable for each chill roll 2, 3.

The temperature of web 1, i.e., the web inlet temperature of first chill roll 2, after the web exits a dryer (not shown) is measured upstream of first chill roll 2 by temperature sensor 10. Temperature sensor 10 may be a noncontacting infrared sensor, or other suitable sensor. Controller device 11 is used to predict the rise in coolant temperature across chill roll 2, 3, the reduction in temperature of web 1 due to each chill roll 2, 3, and an average chill roll surface temperature for each chill roll, for a given temperature of inlet coolant 4, coolant flow rate, velocity of web 1, and web inlet temperature. The velocity of web 1 is sensed by tachometer device 14 and fed to controller device 11. Controller device 11 uses a model of the heat transfer between the web 1, chill roll 2, 3, and coolant 4, 5 to perform predictive calculations. Based on the web inlet temperature, controller device 11 calculates the dew point temperature for vapor of ink solvent of ink printed on web 1. The calculated dew point is used in the heat transfer model. In other embodiments of the present invention, the dew point may be calculated as part of the model. A computer processing device of controller device 11 may perform any of the necessary calculations. One computer processing device, for example a central processing unit (CPU), may determine and/or control coolant set points, such as the inlet coolant temperature and flow rate, for more than one chill roll and/or for chill roll systems of more than one web.

The heat transfer model used by controller device 11 may be a set of equations, for example, based on known thermodynamics, heat transfer and fluid flow equations as well as on physical properties of the web and chill roll system. Such physical properties include the physical dimensions of web 1 and chill rolls 2, 3, as well as thermal properties (specific heat, density, etc.) of web 1 (see, for example, Table 1 below). Assumed or empirically-determined heat transfer coefficients may be used. Moreover, the heat transfer model may be a model which is adaptive to one or more process measurements, such as press speed, web dryer exit temperature, web chill exit temperatures, ambient temperature and coolant flow rate, using sensors as discussed below. Such process measurements may be used to fine tune heat transfer coefficients of the model to a specific web basis weight or printed coverage change on the web. Suitable heat transfer models are known to those of skill in the art, and are therefore not further elaborated upon herein.

In other embodiments of the present invention, coolant conditions may be calculated or interpolated from a lookup table using significant input variables such as press speed and web inlet temperature. Such a lookup table may be generated from a theoretical heat transfer model of the system or from an empirical model. In some embodiments of the present invention, respective inlet coolant temperature and flow rate set points calculated for each chill roll using the heat transfer model may be stored in a memory device. These stored set points could be recalled for later use with the same or similar web and chill roll system properties, thus reducing the calculation burden on control device 11.

According to an embodiment of the present invention, a methodology to set the temperature of inlet coolant 4 and the coolant flow rate for chill roll 2 is as follows:

The dew point temperature of the ink solvent vapor is calculated based on the web inlet temperature. The temperature of inlet coolant 4 is set equal to an offset amount, such as 5° F., for example, below the calculated dew point temperature. A coolant flow rate is selected that maintains the temperature difference of inlet coolant 4 and return coolant 5 below a desired value, such as 10° F., for example, based on the model calculation results. The desired temperature difference value is chosen to maintain a relatively uniform lateral roll and web temperature. Controller device 11 may automatically adjust mixing valve 7 and pump 6 to achieve the desired temperature of inlet coolant 4 and the desired coolant flow rate, respectively. Alternatively, operator interface device 16 may be used to manually adjust mixing valve 7 and pump 6 based on results of the calculations performed by controller device 11. These results may be displayed on operator interface device 16.

The same methodology may be used to set the coolant flow rate and inlet coolant temperature for downstream chill rolls 3. The web inlet temperature immediately upstream of each chill roll may be calculated by controller device 11 using the model, or measured using respective temperature sensors (not shown). The methodology may be repeated for successive chill rolls 3 until the web temperature has reached or goes below the desired exit set point, such as 90° F., for example, at which post-chill marking is avoided. Once the predicted (calculated) or actual (measured) web exit temperature is at or below the set point, the inlet coolant temperature 4 of successive chill rolls 3 may be set equal to an offset below the set point, such as 85° F., for example, to maintain the web temperature substantially constant. The coolant flow rate of these successive chill rolls may be set to a minimal value.

In the event of a web break or web stoppage, it may be desired to warm chill rolls 2, 3 to a temperature slightly above the ambient air dew point to avoid water vapor condensation on the chill rolls or to cool the rolls to improve handling. Water condensation could lead to web breakage on restart of the web. When a web break or stoppage is indicated by tachometer device 14 or other signal, the temperature set point of inlet coolant 4 of cold rolls may be raised to some value to avoid condensation, and the inlet coolant temperature set point of hot rolls may be reduced to improve handling. The raising or lowering of the inlet coolant temperature set point may be performed automatically by controller device 11 or manually by an operator using operator interface 16.

Web temperature sensor 15 may be disposed at the exit of the chill roll system. A feedback signal from this sensor may be used to ensure that the actual web exit temperature is at or below the set point. If the web exit temperature varies from the set point significantly, then the inlet coolant 4 temperature and/or flow rate of coolant of the last chill 3 can be adjusted. If the last roll adjustment is not sufficient, then this adjustment can be applied to additional upstream chill rolls 2, 3.

Additional sensors (not shown) may be added to the system to reduce the required precision of the model equations and to reject unforeseen disturbances. These sensors may include temperature sensors for detecting the temperature of return coolant 5 of a chill roll 2, 3, a temperature sensor and telemetry to monitor the surface temperature of a chill roll, and web temperature sensors placed at intermediate locations in the system.

Though controller 11 may automatically calculate an inlet coolant 4 temperature set point for each of chill rolls 2, 3, an operator may manually intervene using operator interface device 16 to adjust these temperatures based on experience or current operating conditions. Operator intervention may also be allowed for controlling the temperature of surface 20 of chill roll 2, 3, the coolant temperature gradient across the chill roll, or the web temperature immediately downstream of each roll.

When press speed increases are expected, as in restart after a web break, the conditions of the final speed may be used to set coolant parameters. This may improve the transient performance of the chills when the thermal response is slower than the mechanical (i.e., velocity) response.

For a chill system operating under maximum heat load condition, the methodology according to the present invention described above processes the web effectively while keeping lateral temperature gradients at an acceptable level and minimizing flow rate, pump power consumption, and heat exchanger power consumption. When the system is operated at less than maximum load, the control methodology may be altered to effectively process the web while satisfying additional criteria. For example, it may be desirable to minimize pump flow rate (and pump power consumption) and to reduce the rate of web cooling. This goal could be achieved by setting inlet coolant temperature above the dew point temperature and reducing the pump flow rate.

It will of course be understood that the present invention has been described above only by way of example and that modifications of details can be made within the scope of the invention.

What is claimed is:

1. A method for controlling a chill roll system in a web printing press, the method comprising:

calculating, based on a web inlet temperature of a web entering a first chill roll of the chill roll system, a dew point temperature for vapor of an ink solvent of ink printed on the web;

setting an inlet coolant temperature of coolant entering the first chill roll to a first temperature value based on the calculated dew point temperature; and determining, using a heat transfer model, a coolant flow rate of the coolant through the first chill roll needed to maintain a temperature rise of the coolant through the first chill roll below a predetermined value.

2. The method as recited in claim 1 further comprising performing the calculating, setting and determining steps for at least a second chill roll of the chill roll system.

3. The method as recited in claim 1 further comprising calculating a web exit temperature of the web exiting the first chill roll.

4. The method as recited in claim 3 further comprising, when the calculated web exit temperature is close to a desired web exit temperature, setting respective inlet coolant temperatures of coolant entering chill rolls downstream of the first chill roll to a second temperature value based on the desired web exit temperature and setting respective flow rates of coolant through the downstream chill rolls to a minimal flow rate so as to maintain the web at the desired web exit temperature through the downstream chill rolls.

5. The method as recited in claim 4 wherein the second temperature value is equal to an offset below the desired web exit temperature.

6. The method as recited in claim 1 wherein the first temperature value is equal to an offset below the calculated dew point temperature.

7. The method as recited in claim 1 wherein the setting is performed using at least one of a coolant heat exchanger and a coolant mixing valve of the chill roll system.

8. The method as recited in claim 1 wherein at least one of the calculating and the determining is performed using a computer processing device.

9. The method as recited in claim 1 wherein the calculating is based on a property of the ink solvent.

10. The method as recited in claim 1 wherein the determining is performed based on a physical dimension of the first chill roll.

11. The method as recited in claim 1 wherein the determining is performed based on at least one of a velocity of the web through the chill roll system, a physical dimension of the web, and a thermal property of the web.

12. The method as recited in claim 1 further comprising adjusting at least one of the coolant flow rate and the inlet coolant temperature based on a measured web exit temperature of the web exiting the first chill roll.

13. The method as recited in claim 1 further comprising adjusting at least one of a second coolant flow rate and a second inlet coolant temperature of a second chill roll upstream of the first chill roll based on a measured web exit temperature of the web exiting the first chill roll.

14. The method as recited in claim 1 further comprising adjusting at least one of the coolant flow rate and the inlet coolant temperature based on a measured outlet coolant temperature of coolant exiting the first chill roll.

15. The method as recited in claim 1 wherein the determining is performed using a lookup table generated from the heat transfer model.

16. The method as recited in claim 1 wherein the heat transfer model is at least one of a theoretical and an empirical model.

17. The method as recited in claim 1 wherein the heat transfer model is adaptive to at least one process measurement.

18. The method as recited in claim 1 further comprising manually adjusting at least one of the coolant flow rate and the inlet coolant temperature based on at least one of a measured temperature of a surface of the first chill roll, a measured temperature rise of the coolant through the first chill roll, and a measured web exit temperature of the web exiting the first chill roll.

19. A web printing press comprising:

a chill roll control apparatus for a chill roll of the web printing press, the chill roll control apparatus including:

a temperature sensor configured for detecting a web inlet temperature of a web entering the chill roll;

a computer processing device configured for:

calculating, based on the web inlet temperature, a dew point temperature for vapor of an ink solvent of ink printed on the web; and determining, using a heat transfer model, a coolant flow rate of a coolant through the chill roll needed to maintain a temperature rise of the coolant through the chill roll below a predetermined value; and a controllable heat removal system configured for setting an inlet coolant temperature of the coolant entering the chill roll to a first temperature value based on the calculated dew point temperature.

20. The printing press as recited in claim 19 wherein the computer processing device is configured for performing the determining the coolant flow rate based on at least one of a velocity of the web through the chill roll system, a physical dimension of the web, and a thermal property of the web.

* * * * *